United States Patent [19]

Lee

[11] Patent Number: 4,938,536

[45] Date of Patent: Jul. 3, 1990

[54] CONIC MASS CAVING STRUCTURE AND METHOD

[76] Inventor: Raymond C. Lee, 1014 Venhorst Rd., Colorado Springs, Colo. 80920

[21] Appl. No.: 440,886

[22] Filed: Nov. 22, 1989

[51] Int. Cl.[5] ..... E21C 41/00

[52] U.S. Cl. ..... 299/19; 299/18

[58] Field of Search ..... 299/10, 11, 18, 19

[56] References Cited

U.S. PATENT DOCUMENTS

| | | | |
|---|---|---|---|
| 2,298,599 | 10/1942 | Smith | 299/18 |
| 2,536,869 | 1/1951 | Bucky | 299/11 |
| 3,582,138 | 6/1971 | Loofbourow | 299/19 X |
| 4,072,352 | 2/1978 | Janelid | 299/19 |

FOREIGN PATENT DOCUMENTS

| | | | |
|---|---|---|---|
| 516820 | 6/1976 | U.S.S.R. | 299/19 |
| 625039 | 9/1978 | U.S.S.R. | 299/19 |
| 899959 | 2/1982 | U.S.S.R. | 299/10 |

*Primary Examiner*—Stephen J. Novosad
*Assistant Examiner*—David J. Bagnell
*Attorney, Agent, or Firm*—Linda Flewellen Gould

[57] ABSTRACT

Ore may be mined from an irregular ore body using a mining structure which conforms to the shape of the ore body, and which relieves stress that might otherwise hinder caving through bridging and compacting. The conic mass caving structure comprises a series of ore passes, extending from an upper position to a lower position in a tapered fashion. The ore passes intersect each of a series of hyperbolic drifts, which are shaped to surround the portion of the ore body to be mined. The hyperbolic drifts are parallel, and each hyperbolic drift surrounds a smaller area then the hyperbolic drift directly above it, to form an essentially conic shape. Secondary drawpoints are located at the intersection of each ore pass and each hyperbolic drift, while the primary drawpoints are located in a apex surrounded by the lowermost hyperbolic drift. Ore may be drawn from the secondary drawpoints, and either conveyed to the apex through chutes in the ore passes, or transported through crosscuts to a haulage mechanism in a shaft rising to the surface of the ground. The primary haulage mechanism to be utilized will consist of a conveying mechanism running through the haulage drift extending from the apex to a shaft, through which ore is removed vertically to the surface.

12 Claims, 2 Drawing Sheets

CONIC MASS CAVING STRUCTURE AND METHOD

1.0 BACKGROUND OF THE INVENTION.

1.1 Technical Field.

This invention pertains to mining rock or ore from an ore body located below the surface of the ground.

1.2 Background Art.

The extraction of ore from beneath the surface of the ground may be accomplished by a number of different mining methods. Mining techniques based on caving are typically useful for types of ore which will fracture into fragments, such as copper, molybdenum, and silver. Caving methods rely on the removal of rock support beneath ore bodies, causing ore and rock to fragment and subside, facilitating the removal of ore fragments and rock wastes.

Traditional caving methods involve the creation of numerous horizontal work areas, known as drifts, in the area of an ore body. Each drift may have a separate purpose. For example, a caving method utilized for steeply dipping tabular ore bodies may involve an uppermost drift, closest to the surface of the earth, created for the purpose of causing the ore to cave downward from above the drift into an area from which it can be collected. A second drift may be blasted to permit access by vehicles designed to collect and push the ore to a vertical tunnel, or finger raise, where it is lowered to a haulage drift. In the haulage drift, a train system may be utilized to pull the ore back to the surface of the earth. Yet another drift may be utilized to provide ventilation for the mining system. This model of mining is typically referred to as sublevel caving.

A caving technique known as block caving relies on creation of a principal haulage drift, from which finger raises extend upward to a production level. More finger raises are then driven upward to a level from which caving is initiated by drilling and blasting a block of ore. Once an initial block of ore has been removed, the ore above caves under its own weight, forcing crushed fragments of the ore to flow through the finger raises.

These traditional caving methods have a number of important advantages. Although initial construction costs of mines based on caving are usually high, the cost of operating the mines is relatively inexpensive. Once started by drilling and blasting, caving relies primarily on gravity for its operating efficiency, as rock is fragmented without further energy input. These processes prove particularly useful for recovering large, deep, low grade ore bodies. Nevertheless, traditional caving methods have a unique set of disadvantages as well. If caving does not proceed at a consistent rate, bridging may occur as solid ore forms an arch over the cave. No further flow of ore occurs until the arch is broken. Expensive and time-consuming measures may be required to remedy the effects of sporadic bridging. This process is particularly dangerous since abrupt failure of the arch can occur.

A modified caving method is disclosed in Janelid U.S. Pat. No. 4,072,352. Parallel and horizontal drifts are driven, at several levels, into the lower part of a block of ore. The drifts are arranged so that the drift openings form a stepped configuration. Caving is accomplished by blasting an area of ore to undercut a portion of the ore body above drift openings. As openings become damaged or blocked, new draw points may be established through retreat allowing ore removal to continue further back in the same drift.

Smith U.S. Pat. No. 2,298,599 teaches a modified block caving design. Through the use of inclined drifts and a conveyor deck, access to drawpoints is simplified to permit ease of ore removal by mechanical conveyors. Unlike traditional block caving methods, the Smith design does not rely on gravity flow.

Yet another variation of traditional mining techniques is described in Bucky U.S. Pat. No. 2,536,869. The Bucky method is oriented to mining weak ore from narrow, tabular ore bodies, with strong surrounding country rock. Ore is broken in a sloped stope area, and waste fill is introduced at the top of the stope to promote continuous flow of the ore through the stope.

Each of these mining designs is particularly useful for removal of specific types of ore found in ore bodies of a certain shape. Although each design known in the prior art has express advantages, none of these models is configured to conform in three dimensions to the shape of the relevant ore body. Thus, each known mining design must be altered to respond to practical differences in the configuration of each ore body. Furthermore, each known caving technique is susceptible to bridging, resulting in significant mining delays.

2. DISCLOSURE OF THE INVENTION.

2.1 Summary of the Invention.

An object of this invention is to provide an economical and efficient mining method, requiring a minimal number of development drifts and minimal transporting vehicles.

Another object of this invention is to provide a mine design which conforms to the three-dimensional shape of an ore body, adaptable to most efficiently remove rock waste or ore in a variety of configurations.

Yet another object of this invention is to provide a method of caving rock or ore so as to minimize bridging and compacting of rock waste or ore while permitting maximum draw and removal.

The mine structure used in this method of mining rock or ore is shaped so as to conform to the three-dimensional shape of the ore body to be mined. Typically, ore bodies are irregular in shape, so that no particular shape will appropriately conform to more than one ore body. However, the basic structure to be used will have a conic shape, tapering from a larger diameter at the uppermost position of the structure to a smaller diameter at the lowermost position of the structure.

The conic mass caving structure comprises a plurality of hyperbolic drifts, a plurality of ore passes, a caving means, and a hauling means. Each drift may be circular, elliptic, or parabolic, or may comprise a series of curves of different radii and lengths, all of which shapes shall be referred to herein as hyperbolic. The exact shape of each drift is chosen to most efficiently surround or encompass the rock waste or ore to be mined. The hyperbolic drifts are essentially parallel to each other, with one hyperbolic drift forming an uppermost level and another forming a lowermost level of the mining structure. Each drift encompasses an area which is larger than the area encompassed by the drift immediately below it, so that the hyperbolic drifts taper to form an essentially conic shape.

A plurality of ore passes extend from the uppermost hyperbolic drift to the lowermost hyperbolic drift, intersecting each intermediate hyperbolic drift. Secondary drawpoints may be advantageously located in the interior of each hyperbolic drift, with a secondary chute connecting each secondary drawpoint to an adjacent ore pass at an intersection of that ore pass and a hyperbolic drift. Caving may be caused to occur at these secondary drawpoints, by such methods as blasting or drilling out a section of ore.

Rock and ore drawn at the secondary drawpoints may be removed from the mine in one of a number of ways. The rock or ore is drawn through a secondary chute to a hyperbolic drift. A crosscut may be constructed from the hyperbolic drift to a vertical shaft, which shaft extends to the surface of the ground. Vehicles such as LHD's ("Load-Haul-Dump") may be used to push rock and ore from a secondary drawpoint, through the applicable secondary chute and hyperbolic drift to the crosscut, and from there to the shaft. A haulage mechanism within the shaft may then be used to lift the rock waste or ore to the surface.

Alternatively, rock and ore mined at any secondary drawpoint may be transferred through a secondary chute to the ore pass adjacent to that secondary drawpoint. Gravitational forces pull the rock waste or ore through the ore pass to the lowermost hyperbolic drift. Rock and ore may be removed from the lowermost hyperbolic drift by means of a hauling mechanism by which rock and ore are moved through a hauling drift extending horizontally from the lowermost hyperbolic drift to a shaft, and from there vertically to the surface of the ground. Alternatively, the hauling mechanism may be operated in an angled shaft extending at an angle from the lowermost hyperbolic drift to the surface of the ground.

It is contemplated that the majority of the caved rock and ore will be drawn at an apex surrounded by the lowest hyperbolic drift. Removal of rock and ore from this level is easily accomplished by the hauling mechanism which moves through the hauling drift to the vertical shaft. Nevertheless, drawing rock waste or ore at the secondary drawpoints along the higher hyperbolic drifts serves a number of important purposes, including controlling stress of caving, avoiding bridging, and preventing compacting. Both the conic shape of the mine structure and the use of these multiple secondary drawpoints facilitates caving of a broad area with minimal bridging.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

2.2 BRIEF DESCRIPTION OF THE DRAWINGS.

2.3 DETAILED DESCRIPTION OF THE PREFERRED EMBODIMENT

Figure 1:
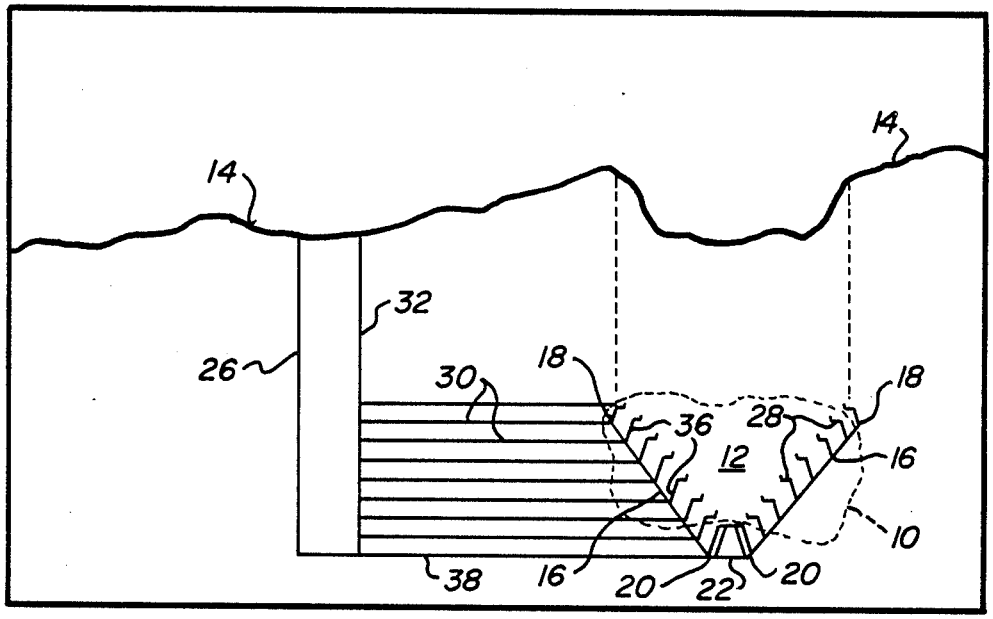
FIG. 1 is a cross-section view of a structure for mining rock waste or ore from an ore body located below the surface of the ground, using the conic mass caving method described herein.

The features of the conic mass caving technique according to the present invention can be better understood by reference to FIG. 1. As is shown in FIG. 1, an ore body 10 has an irregular shape. A plurality of ore passes 16 are constructed so that each ore pass 16 extends from an upper position 18 to a lower position 20. Each ore pass 16 extends downward at an angle to its lower position 20, which is located at an apex 22 beneath the rock waste or ore 12 to be mined. Taken as a whole, the multiple ore passes 16 form an essentially conic shape, which may be configured so as to conform three-dimensionally to the ore body 10.

Figure 2:
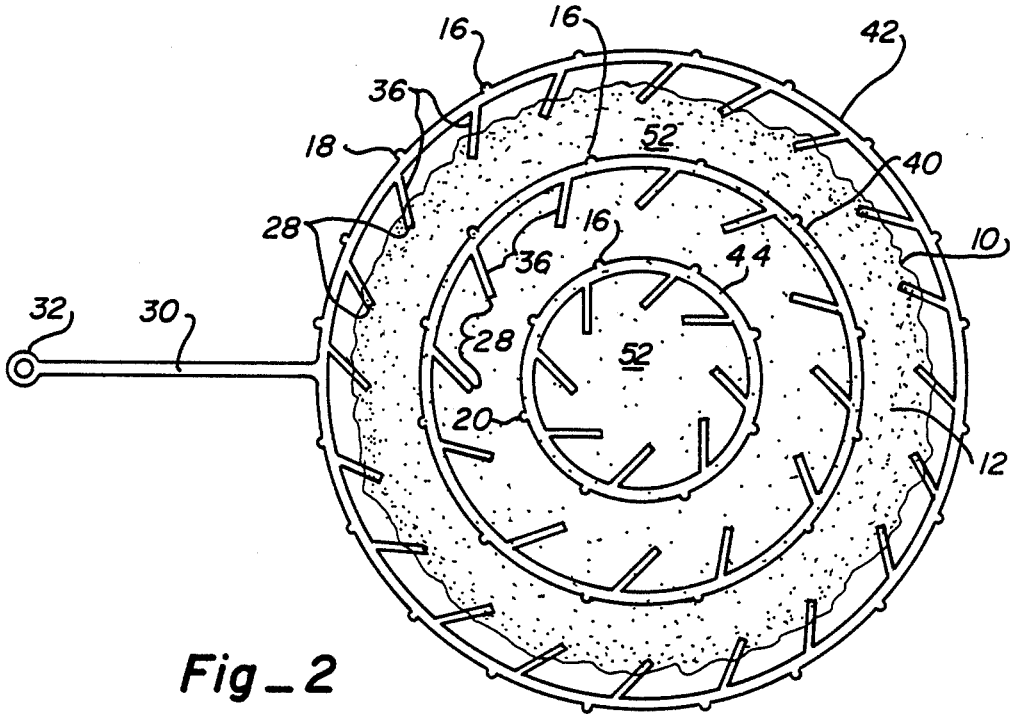
FIG. 2 is a top view of mining structure for mining rock waste or ore using the conic mass caving method.

As is best shown by FIG. 2, hyperbolic drifts 40 are constructed in parallel, descending levels, intersecting each ore pass 16. The upper hyperbolic drift 42 intersects and connects the upper position 18 of each ore pass 16. Similarly, the lower hyperbolic drift 44 intersects and connects the lower position 20 of each ore pass 16. Each hyperbolic drift 40 may be circular, elliptic, or parabolic, or may comprise a series of curves of different radii and lengths, all of which shapes shall be referred to herein as hyperbolic. The exact shape of the hyperbolic drifts 40 is chosen to most efficiently surround or encompass the ore body 10. Each hyperbolic drift 40 encompasses an area which is larger than the area encompassed by the hyperbolic drift 40 immediately below it, so that the hyperbolic drifts 40 taper to form an essentially conic shape.

A plurality of secondary drawpoints 28 may be advantageously located in the interior 52 of the hyperbolic drifts 40. A secondary chute 36 connects each secondary drawpoint 28 with the most adjacent hyperbolic drift 40. The secondary chute 36 may most conveniently connect each secondary drawpoint 28 to a point of intersection of the most adjacent hyperbolic drift 40 and ore pass 16. Rock waste or ore 12 may be caved at each secondary drawpoint 28 by blasting or drilling a portion of the ore body 10.

Once rock waste or ore 12 has been collected at a secondary drawpoint 28, that ore 12 may be removed by one of several possible processes. The ore 12 may be moved by means of a vehicle (not shown) from the secondary drawpoint 28 along the secondary chute 36 to the most adjacent hyperbolic drift 40, and from there through that hyperbolic drift 40. As is shown in FIG. 2, the ore 12 may then be moved along a crosscut 30 extending from the applicable hyperbolic drift 40 to a shaft 32. Movement through the crosscut 30 may be accomplished by a vehicle (not shown) or by a conveyor belt (not shown). At the shaft 32, the ore 12 is transferred to a shaft transport mechanism (not shown) by which the ore 12 is lifted to the surface 14.

Figure 3:
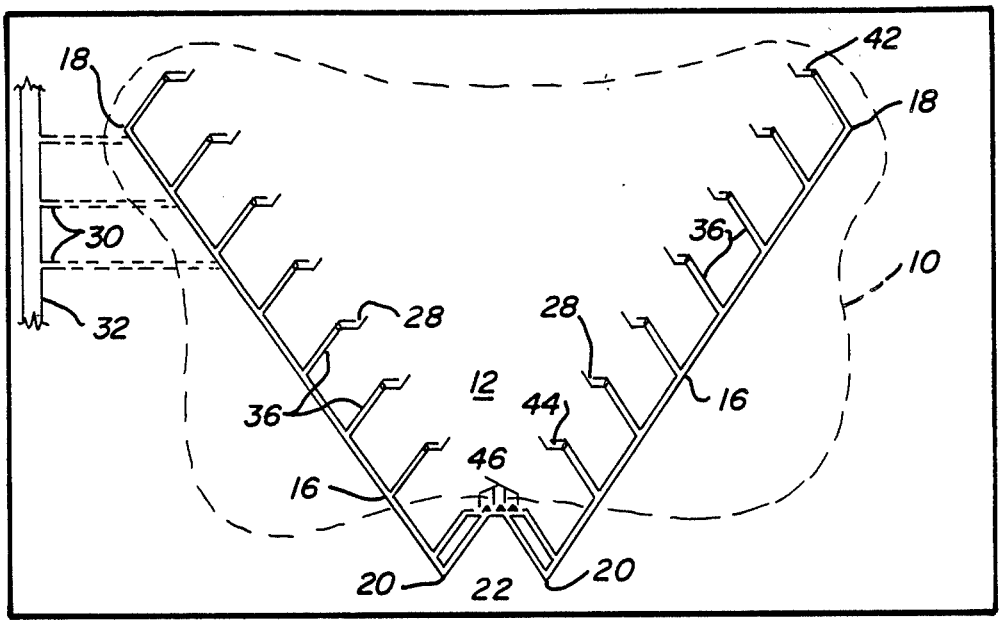
FIG. 3 is a cross-section view of a portion of a structure for mining rock waste or ore using the conic mass caving method.

Alternatively, as is shown in FIG. 3, rock waste or ore 12 drawn at a secondary drawpoint 28 may be moved through a secondary chute 36 adjacent to the secondary drawpoint 28 to the ore pass 16 most adjacent to the applicable secondary drawpoint 28. Gravitational forces pull the ore 12 down the ore pass 16 to the apex 22, from which ore 12 may be removed.

In the preferred embodiment of the conic mass caving system, both crosscuts 30 connecting hyperbolic drifts 40 to a shaft transport mechanism 50 and ore passes 16 are available to remove rock and ore 12 from secondary drawpoints 28. Nevertheless, removal of rock and ore 12 at the secondary drawpoints 28 constitutes only a fraction of the rock and ore 12 which may be conveniently mined using the conic mass caving technique. Rock and ore 12 may be most efficiently removed at primary drawpoints 46 located at the apex 22. Thus, removal of rock and ore 12 at the secondary drawpoints 28 is predominately useful to control grade of the ore 12, and to alleviate stress which might otherwise result in bridging and compacting.

As is shown in FIG. 3, caving at the primary drawpoints 46 may be commenced by removing a portion of the rock waste or ore 12 at each primary drawpoint 46, through methods such as blasting and drilling. Rock waste or ore 12 from the portion of the ore body 10 surrounded by the ore passes 16 may be conveniently drawn into the apex 22 through the primary drawpoints 46.

Figure 4:
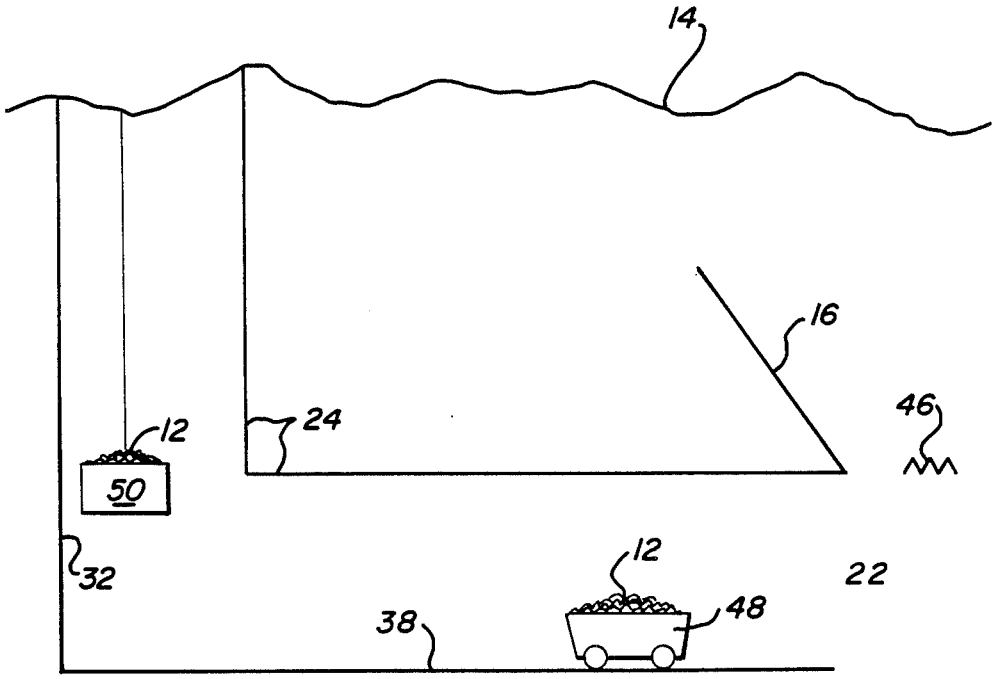
FIG. 4 is a side view of a means for hauling rock waste or ore utilized in the conic mass caving method.

Rock waste or ore 12 drawn at the primary drawpoints 46, together with rock waste or ore 12 conveyed to the apex 22 through the ore passes 16, may be efficiently removed to the surface 14 by a hauling means 24. As is shown in FIG. 4, the hauling means 24 may comprise a shaft 32 extending vertically downward from the surface 14 of the ground, a hauling drift 38 extending horizontally from the shaft 32 to the apex 22, a drift transport mechanism 48 for moving rock waste or ore 12 from the apex 22 through the hauling drift 38 to the shaft 32, a shaft transport mechanism 50 for lifting rock waste or ore 12 from the hauling drift 38 through the shaft 32 to the surface 14, and a mechanism (not shown) for moving rock waste or ore 12 from the drift transport mechanism 48 to the shaft transport mechanism 50. Alternatively, an angled shaft (not shown) may be constructed to connect the apex 22 with the surface of the ground 14, through which a shaft transport mechanism conveys rock waste or ore 12.

The drift transport mechanism 48, the shaft transport mechanism 50, and the mechanism for moving rock waste or ore 12 from one transport mechanism to the other may each comprise equipment commonly known and used in existing mines, such as conveyors, LHD's, lifts, and elevators. As a result, operation of the conic mass caving system is similar to operation of mines existing today, and requires no particular expertise or education for workers skilled in existing mining technology. At the same time, removal of the bulk of the rock and ore 12 through a centralized hauling means 24 creates a situation far more efficient that can be achieved in a traditional sublevel or block caving mine with multiple drawpoints and hauling mechanisms.

Ventilation of the conic mass caving structure may be efficiently achieved through a ventilation means 26 such as intake and exhaust lines parallel to the shaft 32. Intake and exhaust lines may also be efficiently installed within the shaft 32.

A conic mass caving system may be constructed from the uppermost hyperbolic drift 42 to the lowermost hyperbolic drift 44. Alternatively, construction may be commenced in the apex 22, and continue moving upwards toward the uppermost hyperbolic drift 42. Advantages to both methods are apparent. Construction will typically be most easily accomplished at shallower depths constituting the higher drift levels. If increasing stress or rock strength makes development in lower regions infeasible, the conic mass caving system may be abandoned, and traditional sublevel caving may be used at the upper levels already constructed.

Another advantage of constructing the conic mass caving system in a downward direction is the resulting ease of stress on the primary drawpoints 46. Removal of rock waste and ore 12 at each secondary drawpoint 28 significantly decreases the possibility of an arch forming to impede caving, since there are few areas of rock above the primary drawpoints 46 available to support the formation of a bridge. Construction of the secondary drawpoints 28 prior to creation of the primary drawpoints 46 thus eliminates abutments which might otherwise contribute to bridging and compacting. As a result, construction of the conic mass caving system in a downward direction is significantly safer than construction of mines using typical caving methods. At the same time, rock waste may be removed at secondary drawpoints 28, to avoid dilution of the ore to be mined at the apex 22.

On the other hand, development costs associated with the construction of a conic mass caving system may be more evenly spread over the life of the construction of the mine by constructing from lower levels to higher levels. Construction from the apex 22 to the uppermost hyperbolic drift 42 avoids incurring the bulk of the development costs while only minimal ore 12 is being drawn at secondary drawpoints 28.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention.

I claim:

1. A structure for mining rock waste or ore from an ore body located below the surface of the ground, comprising:

(a) a plurality of hyperbolic drifts, including an uppermost hyperbolic drift and a lowermost hyperbolic drift, each hyperbolic drift surrounding an area of the rock waste or ore to be mined, formed so that the hyperbolic drifts are parallel to each other, and formed so that each hyperbolic drift surrounds an area larger than the area surrounded by each lower hyperbolic drift, (b) a plurality of ore passes, each ore pass extending from an upper position connected to the uppermost hyperbolic drift to a lower position connected to the lowermost hyperbolic drift, such that each ore pass intersects each hyperbolic drift, and each ore pass extends downward at an angle so that the lower position of each ore pass is located in an apex beneath the rock waste or ore to be mined, (c) caving means for causing the rock waste or ore to cave downward, so that the rock waste or ore is loosened from the ore body, and (d) hauling means for hauling rock waste or ore to the surface of the ground.

2. A mining structure as described in claim 1, further comprising: ventilation means for exhausting dust and fumes to the surface of the ground.

3. A mining structure as described in claim 1, further comprising:

(a) a plurality of secondary drawpoints through which rock waste or ore may be drawn, and (b) a plurality of secondary chutes, each secondary chute connecting a secondary drawpoint to an ore pass.

4. A mining structure as described in claim 3, further comprising:

(a) at least one crosscut extending from a hyperbolic drift to a shaft containing the hauling means, (b) transportation mechanism for moving the rock waste or ore from a secondary drawpoint through an adjacent secondary chute, through the hyperbolic drift intersecting said secondary chute, and through the crosscut extending from said hyperbolic drift to the shaft, and (c) transferring means for transferring the rock waste or ore from the transportation mechanism in the crosscut to the hauling means located in the shaft.

5. A mining structure as described in claim 3, further comprising:

(a) at least one crosscut extending from a hyperbolic drift to a shaft containing the hauling means, (b) a vehicle for moving the rock waste or ore from a secondary drawpoint through the adjacent secondary chute, through the hyperbolic drift intersecting said secondary chute, and through the crosscut extending from said hyperbolic drift to the shaft, and (c) transferring means for transferring the rock waste or ore from the vehicle to the hauling means located in the shaft.

6. A mining structure as described in claim 3, further comprising:

(a) at least one primary drawpoint located above the apex beneath the rock waste or ore to be mined, (b) mechanism to remove rock waste or ore at the primary drawpoint, causing rock waste or ore above the primary drawpoint to subside into the primary drawpoint.

7. A mining structure as described in claim 1, wherein said hauling means further comprises:

(a) a shaft extending vertically downward from the surface of the ground, (b) a hauling drift extending horizontally from the apex to the shaft, (c) a drift transport mechanism for moving rock waste or ore from the apex through the hauling drift to the shaft, (d) a shaft transport mechanism for moving rock waste or ore from the hauling drift through the shaft to the surface of the ground, and (e) mechanism for moving rock waste or ore from the drift transport mechanism to the shaft transport mechanism.

8. A mining structure as described in claim 1, wherein said hauling means further comprises:

(a) an angled shaft extending from the surface of the ground to the apex, and (b) a transportion mechanism for moving rock waste or ore from the apex through the angled shaft to the surface of the ground.

9. A method for mining rock waste or ore from an ore body located below the surface of the ground, comprising the steps of:

(a) constructing a plurality of hyperbolic drifts, including an uppermost hyperbolic drift and a lowermost hyperbolic drift, each hyperbolic drift surrounding an area of the rock waste or ore to be mined, formed so that the hyperbolic drifts are parallel to each other, and formed so that the area surrounded by each hyperbolic drift is smaller than the area surrounded by the hyperbolic drifts above said hyperbolic drift, (b) constructing a plurality of ore passes, each ore pass extending from an upper position connected to the uppermost hyperbolic drift to a lower position connected to the lowermost hyperbolic drift, such that each ore pass intersects each hyperbolic drift, and each ore pass extends downward at an angle so that the lower position of each ore pass is located in a apex beneath the rock waste or ore to be mined, (b) causing the rock waste or ore to cave downward, so that the rock waste or ore is loosened from the ore body, and (c) hauling rock waste or ore to the surface.

10. A mining method as described in claim 9, wherein construction of the plurality of ore passes is started at the upper position of each ore pass and continued downward.

11. A mining method as described in claim 9, wherein construction of the plurality of ore passes is started at the lower position of each ore pass and continued upward.

12. A mining method as described in claim 9, further comprising:

(a) constructing a plurality of secondary drawpoints, through which the rock waste or ore may be drawn, (b) constructing a secondary chute from each secondary drawpoint to an adjacent ore pass, (c) moving the rock waste or ore from the secondary drawpoints, through the secondary chutes, through the ore passes, to the apex.

* * * * *